United States Patent [19]

Mueller

[11] Patent Number: 4,841,421

[45] Date of Patent: Jun. 20, 1989

[54] HOUSING FOR LONG-FIELD LAMPS HAVING INTERCHANGEABLE LOUVER INSERT

[75] Inventor: Gottfried Mueller, Traunwalchen, Fed. Rep. of Germany

[73] Assignee: Siemens Aktiengesellschaft, Berlin and Munich, Fed. Rep. of Germany

[21] Appl. No.: 263,190

[22] Filed: Oct. 27, 1988

[30] Foreign Application Priority Data

Jan. 15, 1988 [DE] Fed. Rep. of Germany ... 8800431[U]

[51] Int. Cl.[4] ..... F21V 17/02

[52] U.S. Cl. ..... 362/279; 362/290; 362/342; 362/433

[58] Field of Search ..... 362/277, 279, 290, 325, 362/342, 433, 449, 217, 223, 147, 148, 260

[56] References Cited

U.S. PATENT DOCUMENTS

| | | | |
|---|---|---|---|
| 2,139,005 | 12/1938 | Doane | 362/342 |
| 2,214,600 | 9/1940 | Winkler | 362/279 |
| 4,429,354 | 1/1984 | Garnett | 362/342 |
| 4,494,175 | 1/1985 | Gawad et al. | 362/433 |

FOREIGN PATENT DOCUMENTS

| | | | |
|---|---|---|---|
| 533863 | 11/1956 | Canada | 362/342 |
| 1013327 | 7/1977 | Canada | 362/290 |
| 0008004 | 7/1979 | European Pat. Off. . | |
| 2833913 | 2/1980 | Fed. Rep. of Germany . | |

*Primary Examiner*—Ira S. Lazarus
*Assistant Examiner*—Richard R. Cole
*Attorney, Agent, or Firm*—Hill, Van Santen, Steadman & Simpson

[57] ABSTRACT

Housing for long-field lamps comprising interchangeable louver insert. A lock in the form of a spring arm that is secured to the face wall of the housing is suitable for the mutually releasable interlocking of the housing and louver insert in housings of long field lamps having an interchangeable louver insert. This lock has its free end projecting beyond the upper, bent-off edge of the end louver lamella when in engagement with this upper edge and being capable of being unlocked by the accessible gripping surface that is thereby formed. When such a louver is to be interchanged for a louver insert having higher louver lamellae, then, due to the upper, bent-off edge of the end louver lamellae now being higher, a refitting of the lock is required by placing it higher on the face wall of the housing. In order to avoid this, a plate-shaped lock adapter of resilient material is provided, this being secured to the backside of the end louver lamella in bent-off edge parts and, first, lengthening the gripping surface of the lock beyond the upper lamella edge and, second, representing the counterlatch for the lock at the proper height.

4 Claims, 2 Drawing Sheets

HOUSING FOR LONG-FIELD LAMPS HAVING INTERCHANGEABLE LOUVER INSERT

BACKGROUND OF THE INVENTION

The present invention is directed to a housing for long-field lamps having interchangeable louver inserts, whereby one lock is provided for the mutual, releasable interlocking of the housing and louver insert.

German reference DE No. 28 33 913 CS discloses a lock for an interchangeable louver insert in a lamp housing. The lock has a U-shaped carrier having two free legs and a spring arm extending in the direction of the free ends between the legs. The lock has its free legs secured to the inside of at least one face wall of the housing. The spring arm, whose free end is designed as a gripping surface having catch shoulders offset therefrom at both sides, describes an acute angle with the legs and, when the louver insert is introduced into the housing, has its gripping surface slide past and over the upper edge of that end louver lamella of the louver insert that is proximate to it and has its latch shoulders interlocking under a counter-latch that is represented by bent-off, upper edge parts of this end louver lamella.

Such a lock has the advantage that, when the louver is inserted, it is invisible except for the free end of the spring arm that acts as a gripping surface and further that an optical irregularity for the light rays that are also reflected at this end louver lamella cannot occur. What is disadvantageous about such a lock, however, is the fact that the counter-latch formed by the upper, bent-over edge of the end louver lamella of the louver insert has a rigidly prescribed height of a louver lamellae for louver inserts that can be interchanged with one another.

SUMMARY OF THE INVENTION

An object of the present invention is to expand the functionability of the described lock for the mutual, releasable interlocking of the housing and louver insert in long-field lamps for the interchangeability of louver inserts whose louver lamellae have different heights.

In accordance with the present innovation, this object is achieved.

The present invention is based on the fact that the lock, including the location of the fastening thereof at the face wall of the lamp housing, is basically determined by the louver insert whose louver lamellae have the smallest height compared to louver inserts for which it can be interchanged. For adaptation of their end louver lamellae, end louver lamellae of interchangeable louver inserts that have a greater louver lamella height can be provided with a plate-shaped lock adapter of resilient material at the housing side of the lock, this lock adapter being secured in edge-side bent-over portions of this end louver lamella at that side facing toward the lock.

BRIEF DESCRIPTION OF THE DRAWING

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
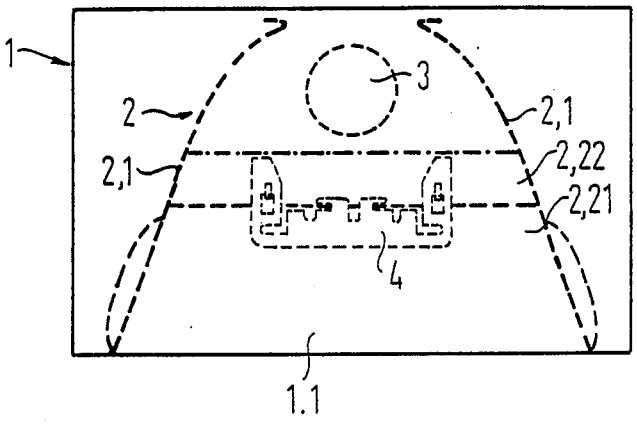
FIG. 1 is a schematic illustration of a long-field lamp in a plan view onto a face thereof, having a lock for the mutual interlock between housing and interchangeable louver insert.

In the long-field lamp schematically illustrated in FIG. 1 showing a face thereof, reference numeral 1 denotes the housing and reference numeral 1.1. denotes the face wall of the housing. A louver insert 2, namely a mirrored louver insert that is composed of the lateral reflectors 2.1 and of the louver lamellae 2.21 arranged transversely relative thereto, is held inside the housing in a lock 4. In FIG. 1, yet another louver insert is indicated, this differing from the illustrated louver insert 2 only in that, replacing the louver lamellae 2.21 having a relatively low height, it has louver lamellae 2.22 whose height significantly exceeds the height of the louver lamellae 2.21. A rod-shaped fluorescent tube 3 whose axis is perpendicular to the plane of the drawings is located in the housing 1 above the louver lamellae.

Figure 2:
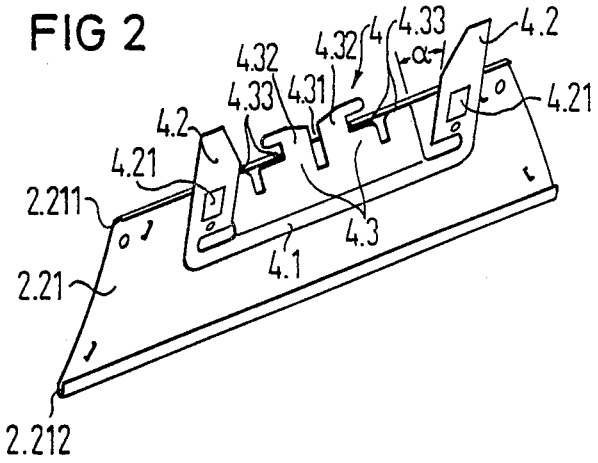
FIG. 2 is a perspective illustration of the lock in engagement with the end louver lamella of the louver insert for the long-field lamp of FIG. 1.

For a better illustration of the mutual interlocking of housing 1 and louver insert 2 by the lock 4, the perspective illustration of FIG. 2 shows the louver lamella that represents an end louver lamella 2.21 in engagement with the lock 4. At its upperside, the end louver lamella 2.21 has a bent-off edge 2.211 that is cut out only in its middle region. The lower edge 2.212 is bent over in a similar fashion. The lock 4 has a U-shaped carrier 4.1 with two free legs 4.2 between which a spring arm 4.3 extends in the direction toward the free ends of the legs. The spring arm 4.3 describes an acute angle $\alpha$ with the legs 4.21 and the free end thereof has a gripping surface 4.32 that is interrupted by a groove 4.31, this gripping surface 4.32 engaging in the engaged condition. Offset relative to the gripping surface 4.32, the spring arm 4.3 has latch shoulders 4.33 at both sides of the gripping surface 4.32 with which the spring arm 4.3 under the upper bent-off edge 2.211 of the end louver lamella 2.21 in the engaged condition of the lock 4.

As FIGS. 1 and 2 depict the legs 4.2 of the lock 4 have rectangular recesses 4.21 into which holders (not referenced in detail in FIG. 1) for fastening the lock 4 to the face wall 1.1 engage. Further, these two FIGs reveal that the gripping surface 4.32 has a projection (likewise not referenced in detail) toward both sides, this projection serving for protection against an unintentional release of the mutual interlock between housing 1 and louver insert 2.

For replacement of the louver insert 2 having louver lamellae 2.21 by a louver insert that has significantly higher louver lamellae 2.22 compared to the louver lamellae 2.21, the lock 4 at the face wall 1.1 would have to be located significantly higher than shown in FIG. 1. Only then, for the higher lamella grid, would the possibility be established that the spring arm 4.3 of the lock 4 has its latch shoulders 4.33 engaging under the bent-off upper edge of the end louver lamella in the manner shown in FIG. 2 and, over and above this, that the spring arm 4.32 could have its gripping surface 4.32 projecting beyond the end louver lamella in order to be able to unlock the lock as needed by actuation of this gripping surface.

Figure 3:
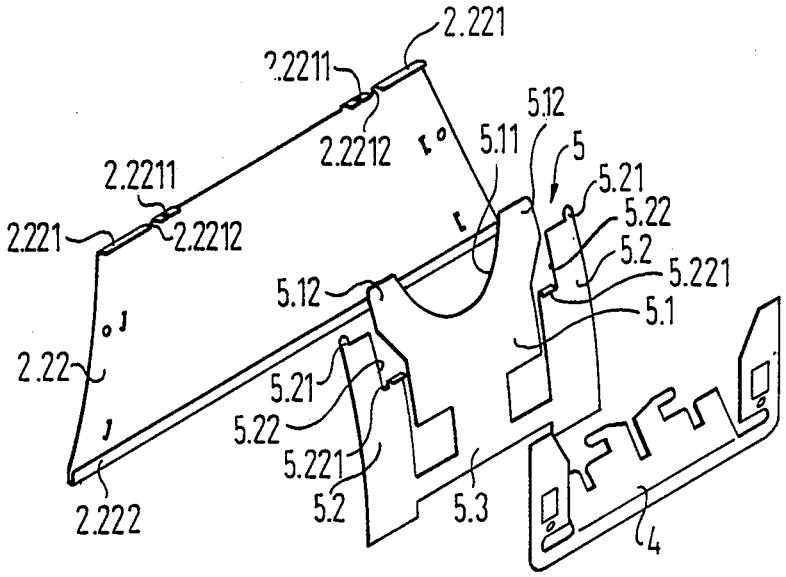
FIG. 3 is a perspective, exploded view of an and louver lamella (including the lock) provided with a lock adapter.
Figure 4:
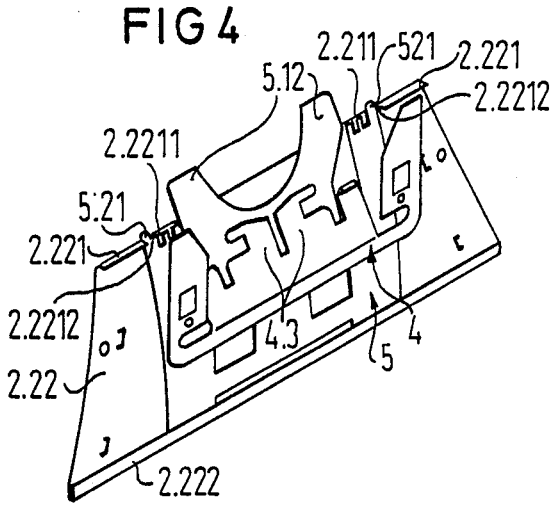
FIG. 4 is a perspective illustration of end louver lamella, lock adapter and lock of FIG. 3 in mutual engagement.

In order to avoid such a refitting of the housing 1 for replacement of the louver insert 2 having louver lamellae 2.21 with a louver insert 2 having higher louver lamellae 2.22, a lock adapter 5 that shall now be set forth in greater detail with reference to FIGS. 3 and 4 is utilized.

In a perspective, exploded view, FIG. 3 first shows the end louver lamella 2.22 of the louver insert 2 having the higher louver lamellae, this end louver lamella 2.22 again having a bent-over edge 2.222 at the underside and partially having a bent-off edge 2.221 at both sides of the upper side. Toward the center, the edge 2.221 at the upper side of the end louver lamella 2.22 is limited by an edge recess 2.2212 to which is joined a narrow edge clip 2.2211. The upperside of the end louver lamella 2.22 does not have a bent-over edge between the edge clips 2.2211.

The lock adapter 5 is a one-piece plate of resilient material, preferably spring sheet metal, that is composed of four parts in terms of its contour. First, it has a broad middle part 5.1 to which frame legs 5.2 that are mirror-image-symmetrical relative to one another join at both sides. The frame legs and the middle part are joined to one another by a T-shaped connector member 5.3 that has its two T-arms joining the frame legs 5.2 laterally at the bottom and has its T-shaft joining the middle part 5.1 at the underside, namely centrally.

On the side of the middle part 5.1, the mirror-image-symmetrical frame legs 5.2 have step offset 5.22 having a bent-off upper step edge 5.221 that forms the counter-latch at the level of the end louver lamella 2.21 of the louver insert according to FIGS. 1 and 2 and that represents the counter-latch for the lock 4.

FIG. 4 shows the lock 4 having the lock adapter 5 in its condition engaged with the end louver lamella 2.22 and shows that it is held in the bent-over edge clips 2.2211 at the upperside. It may also be seen that the lock adapter 5 in the region of the frame legs 5.2 engages into the bent-over edge 2.222 at the underside. The finger projection 5.21 provided at the outer edge at the upperside of the frame legs 5.2 then grabs into the edge recess 2.2212 between the edge clip 2.2211 and the bent-off edge 2.221.

As FIG. 4 also shows, the middle part 5.1, which has a collar-shaped cutout 5.11 at its upperside, has its free ends that represent the gripping surface 5.12 projecting beyond the upper edge of the end louver lamella 2.22, so that the lock 4 that now engages at the lock adapter can be unlocked via these gripping surfaces The middle part 5.1 that can be moved out of its quiescent position at the end louver lamella 2.22 with the gripping surfaces 4.32 is resilient fashion opposite the spring arm 4.3 thus similarly represents a lengthening of the gripping surface for the spring arm 4.3.

The collar-shaped cutout 5.11 is especially meaningful when the louver insert 2 has its louver lamellae 2.22 extending relatively close up to the rod-shaped fluorescent tube 3 and, thus, this collar-shaped cutout 5.11 is required for the fluorescent tube for reasons of space.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A housing for long-field lamps having an interchangeable louver insert whereby at least one lock is provided for the mutual, releasable interlocking of the housing and louver insert, said lock having a U-shaped carrier with two free legs and a spring arm extending between said legs in the direction toward the free ends thereof, whereby said lock, further, has its free legs secured to at least one housing face wall at the inside and the spring arm, whose free end is shaped as a gripping surface having latch shoulders offset relative thereto at both sides, describes an acute angle with said legs, and whereby, upon insertion of said louver insert into said housing, the gripping surface of the spring arm slides across the upper edge of that end louver lamella of the louver insert that is proximate to said spring arm and the latch shoulders of the spring arm engage in locking fashion under bent-off upper edge parts of this end louver lamella that represent a counter-latch, comprising the louver insert being interchangeable with at least one other louver insert that has substantially high louver lamellae and, a plate-shaped lock adapter of resilient material being secured to that end louver lamella of this other louver insert that is proximate to the lock being secured thereto at that side facing toward the lock and between the upper and lower bent-off edges of said end louver lamella, the gripping surface of the lock being lengthened beyond the upper lamella edge by said lock adapter and said lock adapter representing the counter-latch for the lock.

2. The housing according to claim 1, wherein the lock adapter that is composed of one piece is formed by four parts with respect to its contour, a broad middle part two frame legs that are mirror-image-symmetrical relative to one another and are located on either side of the middle part, and a T-shaped connector member joining the frame legs and the middle part to one another, the broad T-arms of said connector member thereby joining the frame legs laterally at the bottom and the T-shaft joining the middle part at its underside centrally; wherein the frame legs of the lock adapter are held with a form-fit at the top in bent-over edge clips and at the bottom in the bent-over edge of the end louver lamella; and wherein the uppersides of the frame legs at the side of the middle part have a step offset that has a bent-off upper step edge that forms the counter-latch.

3. The housing according to claim 2, wherein the middle part of the lock adapter has a collar shaped cutout at its upperside and projects beyond the upper edge of the end louver lamella to which the lock adapter is secured only with ends at both sides of this collar shaped cutout that represent its free gripped surfaces.

4. The housing according to claim 1, wherein the lock adapter is composed of spring sheet metal.

* * * * *